United States Patent [19]

Ricard

[11] Patent Number: 4,882,790

[45] Date of Patent: Nov. 28, 1989

[54] ODOR REMOVING DEVICE FOR TOILETS

[76] Inventor: Vernon F. Ricard, Rte. 2, Crookston, Minn. 56716

[21] Appl. No.: 85,135

[22] Filed: Aug. 14, 1987

[51] Int. Cl.[4] ..... E03D 9/05

[52] U.S. Cl. ..... 4/213; 4/217

[58] Field of Search ..... 4/213–218

[56] References Cited

U.S. PATENT DOCUMENTS

| | | | |
|---|---|---|---|
| 2,309,885 | 2/1943 | Carman | 4/213 |
| 3,277,499 | 10/1966 | Keefauver | 4/213 |
| 3,332,089 | 7/1967 | Wilton | 4/213 |
| 3,967,545 | 7/1976 | Baker | 4/213 |
| 4,007,498 | 2/1977 | Pearson | 4/213 |

FOREIGN PATENT DOCUMENTS

| | | | |
|---|---|---|---|
| 440158 | 12/1967 | Switzerland | 4/213 |

*Primary Examiner*—Werner H. Schroeder
*Attorney, Agent, or Firm*—Herman H. Bains

[57] ABSTRACT

An odor removing device for toilets includes an L-shaped member which is attached to the lower surface of a toilet seat and which defines a collection chamber having a plurality of openings therein. An elongate flexible hose has one end thereof connected to the L-shaped member and has the other end thereof connected to the connector element of a housing. The housing is secured to the ceiling in overlying relation to a conventional ceiling fan and closes the inlet of the ceiling fan. When the ceiling fan is energized, gases and air will be removed by the odor removing device through the L-shaped member into the flexible hose and thereafter into the housing.

6 Claims, 1 Drawing Sheet

ODOR REMOVING DEVICE FOR TOILETS

This invention relates to an odor removing device which is attachable to a conventional toilet.

BACKGROUND OF THE INVENTION

Many types of ventilating devices for toilets have been developed. Most of these prior art devices have never been commercially exploited to any great degree. It is believed that the complexity and expensive construction of these prior art devices are the reasons that they have not successfully entered the marketplace.

For example, U.S. Pat. No. 4,617,687 discloses a ventilated toilet seat which is specially designed to define a passage therein having inlet ports through which the gas passes. The passage in the toilet seat is connected by a flexible conduit to an evacuation device that removes the odors exteriorly of the room.

U.S. Pat. No. 4,094,023 discloses a ventilated seat including a suction tube, which is interconnected by conduits to an evacuation fan arrangement.

U.S. Pat. No. 4,301,555 discloses a replaceable filter for deodorizing the gases from a toilet bowl. The filter is secured to the lower surface of the toilet seat and is provided with ports through which the gases pass. The filter is connected by a vacuum pump line to a vacuum pump, which may be mounted in any convenient location.

U.S. Pat. No. 4,174,545 discloses a ventilating device for toilet bowls, which includes an air chamber structure having a shape generally conforming to the toilet seat. The air chamber structure is connected through an exhaust line to an exhaust fan for exhausting the gases exteriorly of the area.

These prior art Patents are representative of the prior art devices which have been developed, and it will be seen that all of them include specially constructed evacuation fans, which must be positioned to remove the gases from the immediate area. None of the prior art devices are designed to be used in conjunction with the conventional ceiling fans typically provided in conventional bathrooms of many residential homes.

SUMMARY OF THE INVENTION

It is an object of this invention to provide a novel and improved odor removing device for conventional toilets which may be installed and used in conjunction with the conventional ceiling fan for removing gases.

Another object of this invention is to provide a novel kit device including a collection tube which may be readily secured to the lower surface of a conventional toilet seat, which is connected by a flexible hose to a housing attached to the ceiling in covering relation with a ceiling fan for cooperating with the latter when the ceiling fan is energized to remove gases from the bathroom.

These and other objects of the invention will be more fully defined in the following Specification.

FIGURES OF THE DRAWING

DESCRIPTION OF THE PREFERRED EMBODIMENT

Figure 1:
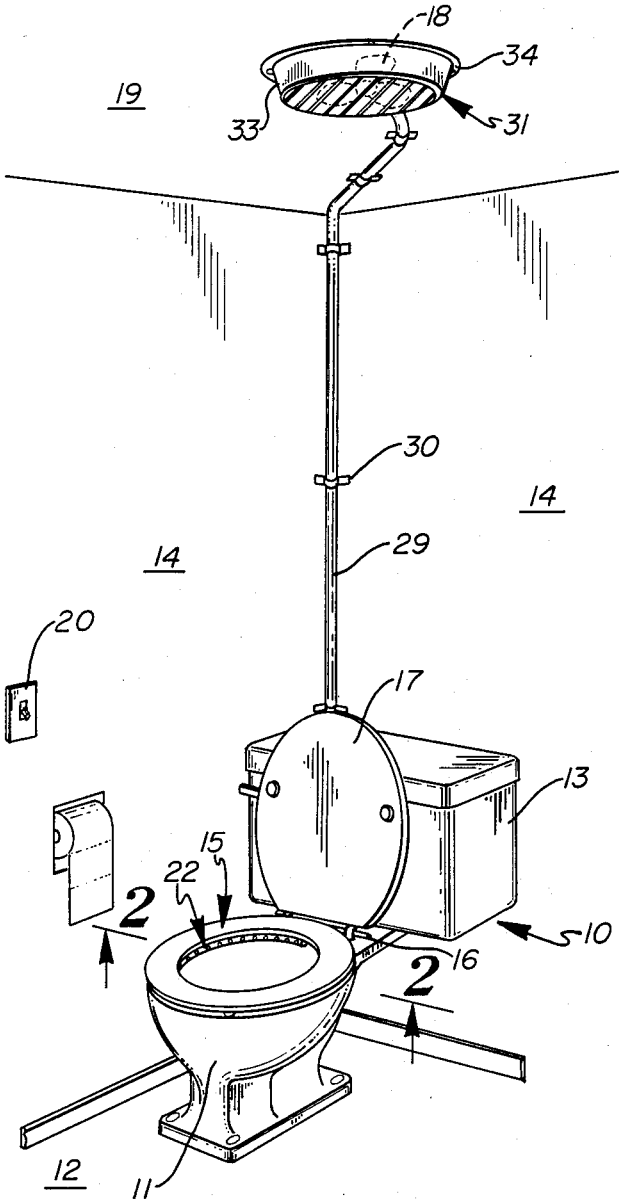
FIG. 1 is a perspective view illustrating a conventional toilet having a novel device attached thereto.

Referring now to the drawings and, more specifically, to FIG. 1, it will be seen that the conventional toilet 10 located in a bathroom is thereshown. The toilet 10 includes a bowl 11, which is secured to the floor 12 of the bathroom. The toilet is also provided with a water jacket 13, which is mounted on one of the vertical walls 14 of the bathroom. Seat 15 is hingedly mounted on the bowl 11 by hinge 16, and the toilet 10 is also provided with a cover 17.

The bathroom is provided with a conventional ceiling fan 18, which is mounted in an opening in the ceiling 19, and which is actuated by a wall switch 20 mounted on one of the vertical walls 14. It will be appreciated that, when the wall switch 20 is moved to the "on" position, the ceiling fan 18 will be energized and air will be evacuated from the interior of the bathroom through the inlet of the fan.

The toilet 10 is provided with a novel odor removing device or attachment, designated generally by the reference numeral 21, and including an L-shaped collection structure or member 22. This L-shaped member 22 may be formed of a somewhat flexible plastic and is of tubular construction so that the interior thereof defines a collection chamber 23. In the embodiment shown, the L-shaped member 22 is secured to the lower surface of the toilet seat 15 so that the L-shaped member extends along one side and the rear of the toilet seat 15. The L-shaped member is provided with a plurality of tabs 25, each having an opening therethrough for accommodating a screw 26 to permit attachment of the L-shaped member 22 to the lower surface of the toilet seat. The L-shaped member is also provided with a plurality of spaced apart openings 24 therein which communicate with the collection chamber 23. It will be noted that, when the L-shaped member 22 is secured to the lower surface of the toilet seat, the openings 24 face inwardly.

The L-shaped member has a closed end 27, which is positioned forwardly and has a fitting 28 secured to its other end. One end of an elongate flexible plastic hose 29 engages the fitting in frictional relation therewith to secure the end of the hose to the fitting. The hose extends upwardly from the L-shaped member 22 towards the ceiling fan 18 and is secured to a vertical wall by suitable mounting clips 30. These clips may be secured to the wall by screws or the like.

In the embodiment shown, an auxiliary housing 31 is provided and is preferably formed of a molded rigid plastic material. The auxiliary housing 31 includes a substantially flat bottom wall having an annular side wall 33 integral therewith and extending upwardly therefrom. The side wall 33 terminates in an outturned annular flange 34, which is provided with a plurality of openings therein for accommodating screws 36. The screws securely attach the auxiliary housing to the ceiling in covering relation to the inlet of the ceiling fan to completely close the inlet from the interior of the bathroom. The housing 31 is provided with a lateral projecting fitting 35, which is integral therewith, and which communicates with the interior of the housing. The upper end of the flexible hose 29 frictionally engages the fitting 35 to secure the hose thereto. With this arrangement, it will be seen that, when the wall switch 20 is moved to the "on" position, the ceiling fan 18 will be energized and will evacuate odors from the bathroom, including the bowl 11 through the hose 29.

Referring again to FIG. 2, it will be noted that the L-shaped member is attached to the lower surface of the toilet seat so that the fitting 28 is positioned adjacent one side of the toilet seat. It is pointed out that the L-shaped member 22 may be applied to the other side of the toilet seat by inverting the L-shaped member and securing it to the seat with the screws. In this regard, the fitting 28 will project in the opposite direction. The selective positioning of the L-shaped member will be done to facilitate installation of the odor removing device.

Figure 3:
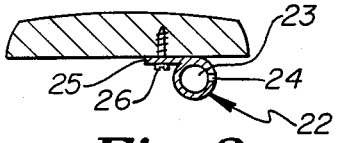
FIG. 3 is a cross-sectional view taken approximately along line 3—3 of FIG. 2 and looking in the direction of the arrows.
Figure 4:
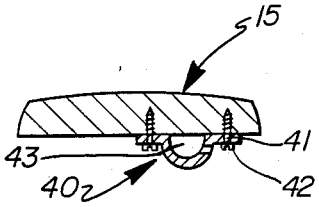
FIG. 4 is a cross-sectional view similar to FIG. 3, but illustrating a modified form of the device.
Figure 5:
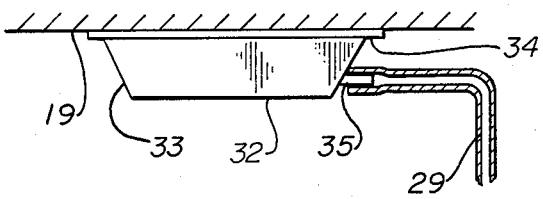
FIG. 5 is a side elevational view of the closure housing for the ceiling fan, with certain parts thereof broken away for clarity.

Referring now to FIG. 4, it will be seen that a different embodiment of the L-shaped member is thereshown. In this embodiment, the L-shaped member, designated generally by the reference numeral 40, is of U-shaped cross-sectional configuration (rather than tubular) and is provided with a plurality of outturned flanges or tabs 41 having openings therein, through which screws 42 are applied to secure the L-shaped member to the toilet seat 15. The L-shaped member is provided with a plurality of openings 43 therein in the manner of the embodiment of FIGS. 1–3, and these openings face inwardly when the L-shaped member is secured to the lower surface of the toilet seat.

Figure 2:
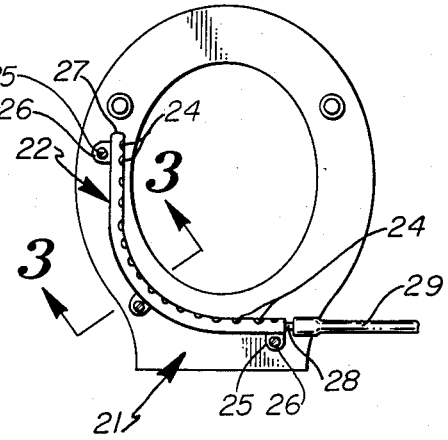
FIG. 2 is a cross-sectional view taken approximately along line 2—2 of FIG. 1 and looking in the direction of the arrows.

However, it is pointed out that the embodiment in FIG. 4 cannot be reversed in the manner of the embodiment of FIGS. 1–3 because of its particular U-shaped cross-sectional configuration. In this regard, the L-shaped member 22 is tubular in cross section and may be inverted without affecting its ability to function as a collection chamber. On the other hand, the U-shaped construction of the embodiment illustrated in FIG. 4 necessarily requires the U-shaped member to be secured to the lower surface of the toilet seat in a particular orientation in order for the L-shaped member to function as a collection chamber. Therefore, one type of U-shaped member 40 will be provided for attachment to one side of a toilet seat, and another will be provided for attachment to the other side of the seat.

It is pointed out that the L-shaped member, hose, and housing may be sold as a kit and may be readily installed by a consumer with a minimum of effort. In this regard, it will be noted that no special tools are required for the attachment of the odor removing device, and that it may be installed without changing or modifying either the toilet or ceiling fan. It has been found that the odor removing device is also effective in preventing conventional bathroom mirrors or windows from becoming fogged because of steam generated when the person takes a bath or shower. By way of contrast, it has been found that, when the same ceiling fan is operated without association with the odor removing device, the conventional fan is simply not effective in preventing the fogging of mirrors or windows.

It will, therefore, be seen from the foregoing description that I have provided a novel odor removing device for use with toilets which is not only of simple and inexpensive construction, but one which functions in a more efficient manner than any heretofore known comparable device.

What is claimed is:

1. An odor removing attachment for use with a toilet positioned in a conventional bathroom having vertical walls and a ceiling, a conventional ceiling fan for exhausting air and gases from the bathroom mounted in an opening in the ceiling, a switch mounted on the bathroom wall for energizing the ceiling fan, the toilet having a generally oval-shaped seat hinged to a bowl, said device comprising an elongate generally L-shaped member having a plurality of longitudinally spaced apart openings therein, means for securing the L-shaped member to the lower surface of the toilet seat so that the L-shaped member extends along one side and along the rear of the toilet seat, said L-shaped member, when secured to the toilet seat, defining a chamber with said openings facing inwardly, a saucer-shaped auxiliary closure housing for the ceiling fan positioned against the ceiling and depending therefrom, said housing including a lower wall and an annular wall integral with the lower wall extending upwardly therefrom, said closure housing having a hollow interior and having a connector element secured thereto and communicating with the interior, means connecting the closure housing with the ceiling to cover and close the inlet of the ceiling fan with respect to the interior of the bathroom, an elongate hose having one end thereof connected to said L-shaped member and having the other end thereof connected to said connector element whereby, when said fan is energized, odors and gases will be evacuated through said L-shaped member into said hose and then into said housing.

2. In combination with a conventional bathroom having vertical walls and a ceiling, a toilet including a bowl having an oval-shaped seat hinged thereto, a conventional ceiling fan mounted in an opening in the ceiling, means for energizing the ceiling fan, an odor removing attachment for the toilet comprising an elongate generally L-shaped member, means attaching the L-shaped member to the lower surface of the toilet seat whereby the interior of the L-shaped member defines a collection chamber, said openings in the L-shaped member facing inwardly when the L-shaped member is attached to the toilet seat, a saucer-shaped auxiliary closure housing for the ceiling fan positioned against the ceiling and depending therefrom, said housing including a substantially flat lower wall, an annular vertical wall integral with said lower wall and extending upwardly therefrom, said closure housing having a hollow interior and having a connector element secured thereto and communicating with the interior thereof, means for securing the housing to the ceiling to cover and close the inlet of the ceiling fan with respect to the interior of the bathroom, and an elongate flexible hose having one end thereof connected to said L-shaped member and having the other end thereof connected to the inlet of said housing whereby, when said fan is energized, air and gases will be exhausted into the L-shaped member through the hose and thereafter into the housing.

3. The odor removing attachment as defined in claim 1 wherein said L-shaped member is of tubular cross-sectional configuration.

4. The odor removing attachment as defined in claim 1 and flange means integral with said annular vertical wall and extending outwardly therefrom.

5. The odor removing attachment as defined in claim 4 wherein said connector is integral with said annular vertical wall and extends outwardly therefrom.

6. The odor removing attachment as defined in claim 2 wherein said L-shaped member is of generally U-shaped cross-sectional configuration.

* * * * *